United States Patent [19]

Cuisia et al.

[11] 4,350,606

[45] Sep. 21, 1982

[54] COMPOSITION AND METHOD FOR INHIBITING CORROSION

[75] Inventors: Dionisio G. Cuisia, Chicago; Chih M. Hwa, Palatine, both of Ill.

[73] Assignee: Dearborn Chemical Company, Lake Zurich, Ill.

[21] Appl. No.: 193,656

[22] Filed: Oct. 3, 1980

[51] Int. Cl.[3] ..... C23F 11/14

[52] U.S. Cl. ..... 252/392; 106/14.15; 106/14.16; 106/14.42; 252/171; 252/357; 252/364; 252/548; 422/16; 564/300; 564/503

[58] Field of Search ..... 252/392, 548, 171, 357, 252/364; 422/16; 106/14.15, 14.16, 14.42; 564/300, 503

[56] References Cited

U.S. PATENT DOCUMENTS

| | | | |
|---|---|---|---|
| 4,067,690 | 1/1978 | Cuisia et al. | 252/387 |
| 4,206,172 | 6/1980 | Sujdak | 252/392 |

OTHER PUBLICATIONS

H. H. Uhlig, Corrosion and Corrosion Control, pp. 252–253, John Wiley & Sons Inc. (1963).

Betz Handbook of Industrial Water Conditioning, Seventh Edition, Chapter 20, pp. 152–157 (1976).

*Primary Examiner*—Irwin Gluck

*Attorney, Agent, or Firm*—Mark T. Collins

[57] ABSTRACT

Corrosion in steam condensate lines is inhibited by maintaining a mix of a hydroxylamine compound and a neutralizing amine in the water.

24 Claims, No Drawings

COMPOSITION AND METHOD FOR INHIBITING CORROSION

This invention relates to novel treating compositions which are useful in inhibiting corrosion in steam condensate systems and other aqueous systems in which the mineral content is relatively low. The purpose of the invention is to provide corrosion protection for metal parts such as steam valves, steam traps, return condensate lines and heat exchangers and particularly, to prevent pitting and grooving attack of iron base metals and non-ferrous alloys.

More particularly, the subject invention is directed to the use of a hydroxylamine compound in combination with one or more volatile, neutralizing amines such as cyclohexylamine, morpholine, diethylaminoethanol, dimethylpropanolamine, and 2-amino-2-methyl-1-propanol. The hydroxylamine compound has the following general formula:

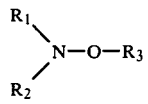

wherein $R_1$, $R_2$, and $R_3$ are either the same or different and selected from the group consisting of hydrogen, lower alkyl having between 1 to about 8 carbon atoms, and aryl such as phenyl, benzyl and tolyl. Specific examples of hydroxylamine compounds usefully employed herein include hydroxylamine, oxygen-substituted and nitrogen-substituted derivatives.

It is well known that steam lines and steam condensate lines are subject to corrosion which is very difficult to control. This corrosion is principally caused by the presence of two impurities in the steam, namely, carbon dioxide and oxygen. Carbon dioxide causes the grooving or channeling attack on metal surfaces while pitting attack is typical of oxygen. The carbon dioxide is commonly controlled by the use of neutralizing amines such as those given above. Unlike caustic soda, soda ash and sodium phosphate, the amines mentioned above are acceptable for steam condensate application because they are sufficiently volatile reaching every area that is reached by steam and carbon dioxide, and they condense and react wherever a condensate forms. The volatility (also known as vapor-liquid distribution ratio) of the amines, however, varies significantly. For example, cyclohexylamine with high distribution ratio (2.6) tends to escape through the vents in the system and is often recommended for low pressure systems, while morpholine with low distribution ratio (0.48) tends to accumulate in the boiler water resulting in substantial loss through the blowdown. Morpholine is often used for high pressure systems.

The primary disadvantage of neutralizing amines is their inability to provide protection against oxygen attack. Many plants do encounter air leakage into the return system and use of the neutralizing amines alone will not completely prevent corrosion under such conditions.

We found that the combinations of a hydroxylamine compound and one or more neutralizing amines will reduce both the carbon dioxide and oxygen gases that may be present in the steam condensate. Furthermore, the presence of neutralizing amines provides a catalytic effect in the reaction of a hydroxylamine compound and oxygen, making the removal of oxygen fast enough even at relatively low temperature for immediate corrosion protection in the steam condensate systems.

The oxygen scavenging activity of N,N-diethylhydroxylamine (DEHA) in combination with neutralizing amines was compared to the activity of N,N-diethylhydroxylamine alone. The effect of neutralizing amines by itself to the dissolved oxygen was also determined.

The tests were performed in the laboratory using a 4.5-liter reaction vessel containing distilled water saturated with dissolved oxygen and 10 ppm $CO_2$. A 5-gallon batch of distilled water was saturated with oxygen by bubbling air through a fritted dispersion tube. The carbon dioxide was naturally present in the distilled water.

The 4.5-liter container was filled up with the oxygen-saturated water containing 10 ppm $CO_2$. The water temperature was adjusted at 70°±2° F. The dissolved oxygen was determined by means of a commercially available oxygen meter equipped with selective membrane electrode. The oxygen meter probe after calibration was inserted into the top of the container. The first test was conducted by injecting 36 ppm, N,N-diethylhydroxylamine. The subsequent decrease in oxygen concentration was measured as a function of time. Similar experiments were performed by using the same amount of DEHA and adding neutralizing amines to pH 8–8.5. Other tests with neutralizing amines but without DEHA were conducted to determine the effect of the amines by itself. The Table illustrates the catalytic activity of the neutralizing amines in promoting the reaction of DEHA and oxygen in a low temperature water containing both dissolved oxygen and carbon dioxide.

TABLE

| | | Removal of Oxygen | | | | | |
|---|---|---|---|---|---|---|---|
| | | Dissolved Oxygen, ppm $O_2$ | | | | | |
| Ex. | Time, Minutes | 0 | 15 | 30 | 60 | 90 | 120 |
| 1. | N,N-Diethylhydroxylamine (DEHA) | 9.70 | 8.76 | 8.08 | 6.50 | 5.60 | 5.40 |
| 2. | Morpholine (I) | 9.43 | 9.26 | 8.85 | 8.70 | 8.61 | 8.60 |
| 3. | Cyclohexylamine (II) | 9.50 | 9.03 | 8.88 | 8.76 | 8.66 | 8.60 |
| 4. | Diethylaminoethanol (III) | 9.86 | 9.60 | 9.57 | 9.50 | 9.50 | 9.50 |
| 5. | Dimethylpropanolamine (IV) | 9.65 | 9.04 | 8.63 | 8.43 | 8.39 | 8.36 |
| 6. | 2-Amino-2-methyl-1-propanol (V) | 8.63 | 8.52 | 8.45 | 8.25 | 8.12 | 8.12 |
| 7. | DEHA + I | 8.22 | 5.54 | 3.90 | 1.97 | 1.23 | 0.87 |
| 8. | DEHA + II | 8.60 | 4.70 | 2.63 | 1.05 | 0.54 | 0.33 |
| 9. | DEHA + III | 9.48 | 4.53 | 2.21 | 0.80 | 0.42 | 0.32 |
| 10. | DEHA + IV | 8.36 | 5.30 | 3.31 | 1.66 | 0.92 | 0.66 |
| 11. | DEHA + V | 8.10 | 5.45 | 3.81 | 2.07 | 1.36 | 1.05 |
| 12. | DEHA + (I & II) | 9.52 | 4.70 | 2.33 | 0.71 | 0.31 | 0.21 |
| 13. | DEHA + (I, II, III, IV & V) | 9.80 | 3.50 | 1.40 | 0.34 | 0.18 | 0.13 |

It is evident from the Table that the combinations of DEHA and one or more neutralizing amines were more effective than the DEHA alone when the water contained both carbon dioxide and oxygen. As expected, the neutralizing amines alone did not significantly reduce the oxygen content. With the DEHA alone the oxygen was reduced by 44.3% as compared to 89.4% with a combination of DEHA and morpholine and 98.7% with a combination of DEHA and a mixture of five amines.

In the Table, in Example 12, the weight ratio of I:II was 1:1; and in Example 13, the ratio of I:II:III:IV:V was 1:1:1:0.5:0.5.

It is known (U.S. Pat. No. 4,067,690) that DEHA alone is an oxygen scavenger and corrosion inhibitor in boiler systems. Our work has shown, however, that it is relatively slow reacting by itself in condensate lines. See Example 1 in the Table. It is surprising that DEHA can be converted to an effective, fast-acting oxygen scavenger and inhibitor of corrosion due to dissolved oxygen by maintaining an amine in the condensate along with the DEHA.

The following hydroxylamine compounds according to this invention show similar unexpected oxygen scavenging activities when tested in combination with one or more neutralizing amines.

| Example No. | |
|---|---|
| 14 | N,N-Dimethylhydroxylamine |
| 15 | N-Butylhydroxylamine |
| 16 | O-Pentylhydroxylamine |
| 17 | N,N-Dipropylhydroxylamine |
| 18 | N-Heptylhydroxylamine |
| 19 | O-Ethyl N,N-dimethylhydroxylamine |
| 20 | N-Benzylhydroxylamine (β-Benzylhydroxylamine) |
| 21 | O-Benzylhydroxylamine (α-Benzylhydroxylamine) |
| 22 | O-Methyl N-propylhydroxylamine |
| 23 | N-Octylhydroxylamine |
| 24 | N-Methyl N-propylhydroxylamine |
| 25 | N-Hexylhydroxylamine |

At equilibrium operating conditions we prefer to maintain the level of the hydroxylamine compound in the condensate at 0.001 to 100 ppm (more preferably, about 5 ppm); and the second amine (or amine mix) at 1 to 1,500 ppm (more preferably, about 100 ppm).

The components can be added separately or in admixture, and can be added to the boiler feed water and/or directly to the condensate lines. When added as a mix, we prefer a mix in which the weight ratio of the hydroxylamine compound:amine is about 0.001 to 1:1, or more preferably about 0.05:1.

One good way to add the composition is first to add the preselected amount of the hydroxylamine compound and after that, add the second amine or amine mix until the pH of the condensate or the like is 8–8.5. This method was used in the runs for the Table.

The amine component is a volatile neutralizing amine. Such amines are well known in the boiler water condensate art. They are conventionally added to react with carbon dioxide dissolved in the condensate. Typical of such amines are morpholine, cyclohexylamine, diethylaminoethanol, dimethylpropanolamine, 2-amino-2-methyl-1-propanol, dimethylpropylamine, benzylamine. See H. H. Uhlig, "Corrosion and Corrosion Control," pp. 252–253, John Wiley & Sons Inc. (1963). Mixtures of amines can be used.

What is claimed is:

1. Composition consisting essentially of a hydroxylamine compound having the general formula

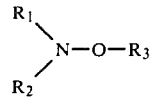

where $R_1$, $R_2$, and $R_3$ are either the same or different and selected from the group consisting of hydrogen, lower alkyl and aryl, and the water-soluble salts thereof, and a second neutralizing amine.

2. Composition according to claim 1 in which the hydroxylamine compound is N,N-diethylhydroxylamine.

3. Composition according to claim 2 in which the weight ratio of N,N-diethylhydroxylamine:second amine is about 0.001 to 1:1.

4. Composition according to claim 3 in which the second amine is a member selected from the group consisting of cyclohexylamine, morpholine, diethylaminoethanol, dimethylpropanolamine, or 2-amino-2-methyl-1-propanol.

5. Composition according to claim 4 in which the second amine is morpholine.

6. Composition according to claim 4 in which the second amine is cyclohexylamine.

7. Composition according to claim 4 in which the second amine is diethylaminoethanol.

8. Composition according to claim 4 in which the second amine is dimethylpropanolamine.

9. Composition according to claim 4 in which the second amine is 2-amino-2-methyl-1-propanol.

10. Composition according to claim 4 in which the second amine is a mixture of two or more amines selected from the group consisting of cyclohexylamine, morpholine, diethylaminoethanol, dimethylpropanolamine, or 2-amino-2-methyl-1-propanol.

11. Composition according to claim 10 in which the second amine is a mixture of morpholine and cyclohexylamine.

12. Composition according to claim 10 in which the second amine is a mixture of morpholine, cyclohexylamine, diethylaminoethanol, dimethylpropanolamine, and 2-amino-2-methyl-1-propanol.

13. Method of inhibiting corrosion in steam condensate lines, comprising maintaining in solution therein, 0.001 to 100 ppm of a hydroxylamine compound having the general formula:

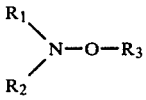

wherein $R_1$, $R_2$, and $R_3$ are either the same or different and selected from the group consisting of hydrogen, lower alkyl and aryl, and the water-soluble salts thereof, and 1 to 1,500 ppm of at least one additional neutralizing amine.

14. Method according to claim 13 in which the hydroxylamine compound is N,N-diethylhydroxylamine.

15. Method according to claim 14 in which the N,N-diethylhydroxylamine is maintained at about 5 ppm and the additional amine at about 100 ppm.

16. Method according to claim 14 in which the additional amine is a member selected from the group consisting of cyclohexylamine, morpholine, diethylaminoethanol, dimethylpropanolamine, or 2-amino-2-methyl-1-propanol.

17. Method according to claim 16 in which the additional amine is morpholine.

18. Method according to claim 16 in which the additional amine is cyclohexylamine.

19. Method according to claim 16 in which the additional amine is diethylaminoethanol.

20. Method according to claim 16 in which the additional amine is dimethylpropanolamine.

21. Method according to claim 16 in which the additional amine is 2-amino-2-methyl-1-propanol.

22. Method according to claim 16 in which the additional amine is a mixture of two or more amines selected from the group consisting of cyclohexylamine, morpholine, diethylaminoethanol, dimethylpropanolamine, or 2-amino-2-methyl-1-propanol.

23. Method according to claim 22 in which the additional amine is a mixture of morpholine and cyclohexylamine.

24. Method according to claim 22 in which the additional amine is a mixture of morpholine, cyclohexylamine, diethylaminoethanol, dimethylpropanolamine, and 2-amino-2-methyl-1-propanol.

* * * * *